United States Patent [19]

Leonhardt et al.

[11] 4,326,363

[45] Apr. 27, 1982

[54] WAISTED ENVELOPE FOR TUBULAR BUILDING STRUCTURES

[76] Inventors: Fritz Leonhardt; Wolfhart Andrä; Wilhelm Zellner; Jörg Schlaich; Gunter Mayr, all of Lenzhalde 16, D-7000 Stuttgart, Fed. Rep. of Germany

[21] Appl. No.: 85,702

[22] Filed: Oct. 17, 1979

[30] Foreign Application Priority Data

Oct. 17, 1978 [DE] Fed. Rep. of Germany ..... 2845194

[51] Int. Cl.[3] ..... E04B 1/32

[52] U.S. Cl. ..... 52/80; 52/83; 52/222; 52/245

[58] Field of Search ..... 52/222, 83, 80, 245, 52/223 R; 261/DIG. 11

[56] References Cited

U.S. PATENT DOCUMENTS 3,637,193 1/1972 Kugler et al. ..... 261/DIG. 11
3,994,108 11/1976 Johnson ..... 52/222 X
4,060,575 11/1977 Uhlirsch et al. ..... 52/83 X
4,106,244 8/1978 Kessler et al. ..... 261/DIG. 11
4,148,850 4/1979 Schulte et al. ..... 52/222 X

FOREIGN PATENT DOCUMENTS 2416043 10/1975 Fed. Rep. of Germany ..... 52/245
1183193 3/1970 United Kingdom ..... 261/DIG. 11

*Primary Examiner*—Price C. Faw, Jr.
*Assistant Examiner*—Carl D. Friedman
*Attorney, Agent, or Firm*—Pennie & Edmonds

[57] ABSTRACT

A waisted envelope for tubular building structures, such as cooling towers, is supported by way of a supporting structure, joined with its top end and responsible for a pulling or pretensioning force, on a system taking up the vertical component of the pulling force. The envelope is designed as a membrane made of material designed for supporting tension within its plane in all directions.

5 Claims, 5 Drawing Figures

WAISTED ENVELOPE FOR TUBULAR BUILDING STRUCTURES

TECHNICAL FIELD

The invention relates to a waisted envelope for tubular building structures, such as cooling towers, which is supported, a pulled condition being produced, by way of a support, joined with its top end, on a system taking up the vertical component of the pulling force, and which is designed as a membrane made of material designed for taking up pulling forces within its plane in all directions.

SUMMARY OF THE INVENTION

Taking the U.S. Pat. No. 4,010,580 as a starting point, the purpose of the present invention is that of increasing the range of changes which may be made in the form of the envelope and making possible design for different purposes of use.

For effecting these and other purposes, in the present invention, the envelope is made up of waisted envelope-parts, one over the other and joined together, there being support or stiffening rings at the joins between the envelope-parts.

With this teaching of the present invention, it is possible to make generally cylindrical envelopes, which, for a certain given cooling rate have the lowest possible envelope area. It is, however, possible for any other form of envelope to be produced, for example in the form of a frustum of a cone with the narrower part at the top or at the lower end, as may be needed for meeting special flow or current conditions. The support or stiffening rings may be joined by sloping ropes with the system taking up the vertical component of the pulling force in order to make changes in the pulling force of the envelope for designs meeting different wind cutting forces. Furthermore the pulling forces may in part be short circuited by way of this construction.

The invention makes possible the design of very narrow envelopes as are needed for making use of a chimney draft effect for specially high towers. In this respect the lower part of envelope may be made wider to take the form of a sort of porch or cover. It is furthermore possible, if necessary, to make use of guide ropes, which are fixed at the top edge or at another level of the envelope.

If envelopes with very great diameters are to be produced, the system responsible for taking up the vertical component of the pulling force, may, in the present invention, be made up of a number of uprights, which are placed in a ring and used for supporting the supports fixed to the top end of the envelope. The sizes may undergo such a selection that a power station may be placed within its cooling tower.

In the case of such a construction with one or more uprights it may be specially useful for the one or more uprights to be joined at the side with the membrane for decreasing the buckling length. In this way the necessary cross-section of each upright may be greatly decreased.

In a further development of the invention the material, which is designed for taking up pulling forces within its plane in all directions, may be made of boarding. For this reason the envelope design may well be used in parts of the country where there are great amounts of timber on hand and in which other materials may be hard to come by. Furthermore, timber is hardly damaged by chemicals as may be used, more specially, in wet cooling processes.

The process of the invention for making the envelope is characterised in that the envelope of sheet metal, of timber, or the like is put together on one side of an assembly network which is acted upon by a pulling force, has the same form as the completed envelope and is more specially a three family network, and then acted upon by a pulling force, that is to say pre-tensioned or tensioned. For this reason the building up of the envelope may be made very much simpler (more specially in the case of buildings of great size) than is the case with a form of assembly, in which the envelope is pieced together while at the same time being lifted upwards, a way of building such a structure in which wind or other forces may be responsible for a certain level of danger to persons taking part in the building operation.

The assembly network is taken to pieces before the envelope is acted upon by the pulling force and may then be used for the same sort of building operation again. It is however possible, as part of the present invention, for the assembly network to be kept in the position as a further supporting element of the envelope. The envelope will then be made up of the rope network, acted upon by a pulling force, and a membrane, as well acted upon by such a force, although however the two do not have to be joined together at every knot in the network and only have to be joined together by way of the supporting and stiffening rings or only, in certain cases, by way of the top ring. The making good of any damage to the membrane is quite simple, because the rope network may be responsible for the supporting function in different stages of building by itself.

BRIEF DESCRIPTION OF THE DRAWING

An account will now be given of the invention in more detail, making use of preferred forms of the invention to be seen in the figures.

BEST MODE OF CARRYING OUT THE INVENTION

Figure 1:
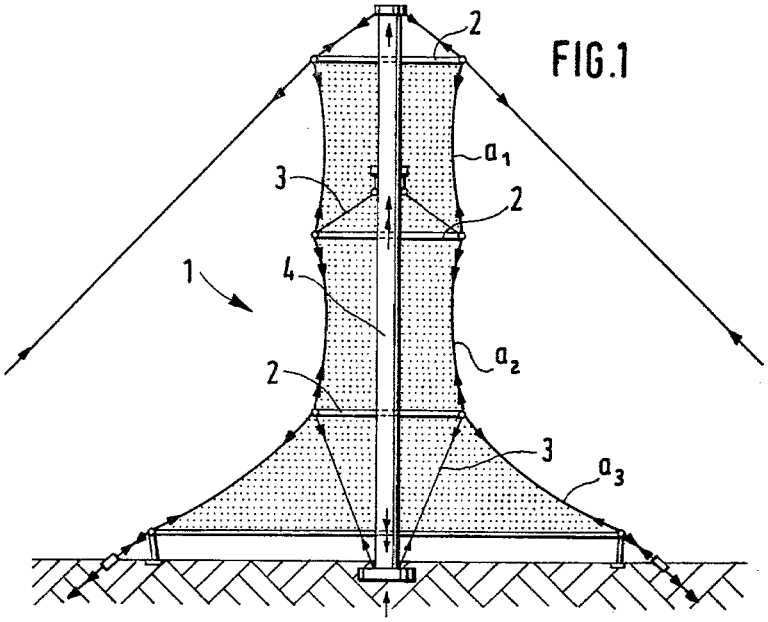
FIG. 1 is a diagrammatic sideview of a thin, that is to say slim tower.

The tower of FIG. 1 has an envelope 1 made up of three waisted envelope-parts $a_1$, $a_2$ and $a_3$, placed one over the other. The lower envelope-part $a_3$ is formed as a wide porch structure while the upper envelope-parts are responsible for forming the generally speaking thin or slim tower itself. At the joins between the envelope-parts $a_1$ to $a_3$ and at the top end of the membrane there are support or stiffening rings 2 which are joined by way of sloping ropes 3 with a middle upright 4. The thin high tower is positioned by guide ropes coming from the top edge and joined with the ground in some way, so that the tower is stabilized for a further reason.

Figure 2:
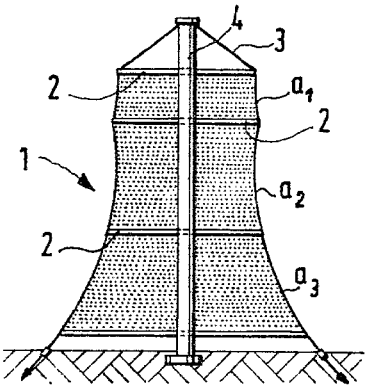
FIG. 2 is a view, on the same lines, of a cooling tower.

The cooling tower of FIG. 2 as well is made up of a membrane 1 with the membrane-parts $a_1$, $a_2$ and $a_3$. In this respect the design is such that the tower has a generally speaking cylindrical form which may have the lowest possible envelope area.

Figure 3:
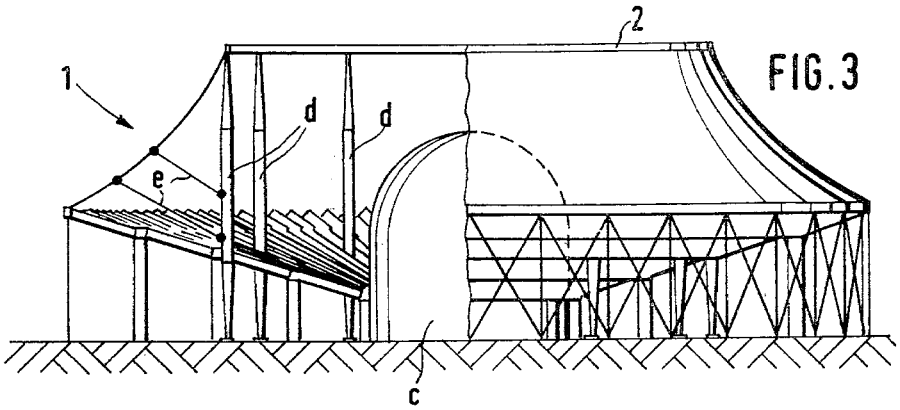
FIG. 3 is a part cutaway diagrammatic sideview of a cooling tower representative of another form of the invention.

Unlike the towers of FIGS. 1 and 2, which may readily be some hundreds of meters high, in the case of the cooling tower of FIG. 3 it is a question of a generally speaking low building structure of the order of about hundred meters tall, in the case of which however the lower edge of the membrane 1 may have a diameter of the order of 250 meters. Within the tower a power station c is placed. The top supporting or stiffening ring 2 is supported by a number of uprights d and furthermore for decreasing the buckling length the system is so designed that the uprights d are supported by the membrane, acted upon by a pulling force, by way of support rods e, the membrane taking the form of the envelope 1.

Figure 4:
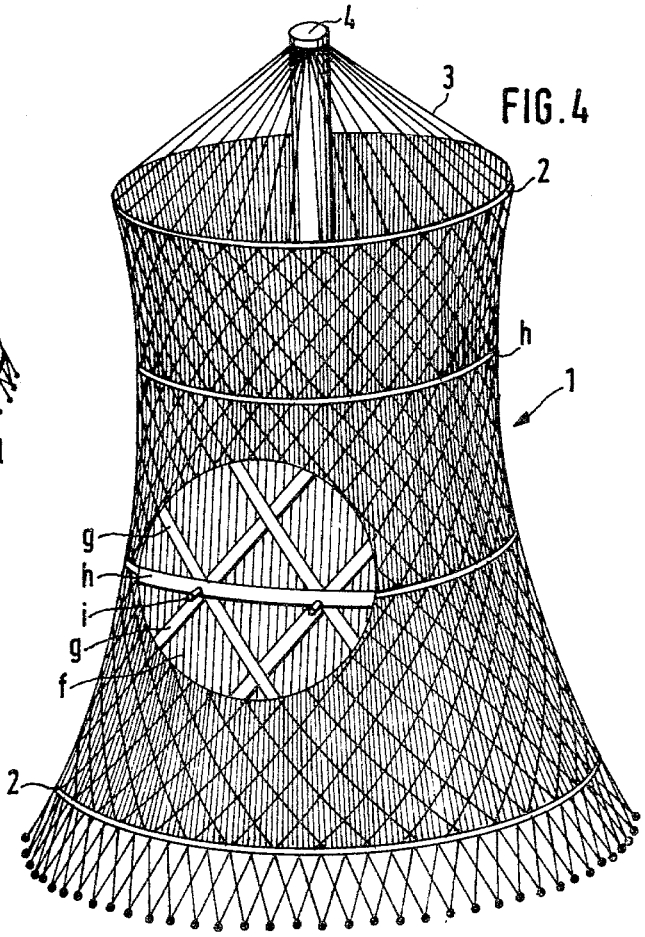
FIG. 4 is a sideview of a cooling tower of special membrane material.

In the case of the cooling tower of FIG. 4 the membrane, forming the envelope 1, is made up of boarding. This boarding is made up of a dense or liquid-tight casing f of boards which are specially impregnated, and furthermore of left-handed and right-handed upwardly running belts g for making the structure strong with respect to pulling forces in all directions. Furthermore, the structure has bulkhead outer rings h of board plywood with radially running or spoking ropes i.

Figure 5:
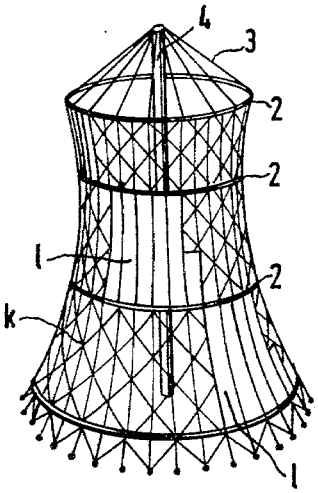
FIG. 5 is a diagrammatic view to make clear the process of the invention.

An account will now be given of the process for forming the envelope of FIG. 5. In this respect, at the start, a three family assembly network k has been put up, it being acted upon by pulling forces. For this purpose use is made of the middle upright 4, of the support or stiffening rings 2 and of the ropes 3. On this assembly network the membrane, later taking the form of the envelope, is pieced together using the separate parts 1. After the envelope has been completed and fixed to the supporting and stiffening rings 2, it is possible for the assembly network k to be taken from it and then the membrane may be pulled tight. As a further possible way the rope network, as a structure-part with its own supporting function, may be used as part of the envelope together with the membrane.

What we claim is:

1. An envelope for building structures comprising at least one envelope part each characterized by a membrane of waisted shape, a system for supporting each envelope part comprising at least a pair of stiffening rings, each said envelope part being pretensioned in substantially the axial direction and individually connected at both top and bottom locations to one of said stiffening rings, and means for supporting the uppermost stiffening ring thereby to take up the vertical component of a pulling force exerted by each envelope part, and wherein each envelope part is of a membrane design and material which in a pulled condition takes up pulling forces within its plane in all directions resulting in stabilization of the envelope part to a self-supporting condition.

2. The envelope of claim 1 wherein each said membrane comprises a plurality of parts which are joined together.

3. The envelope of claim 1 comprised of a plurality of envelope parts, and wherein said system comprises a stiffening ring both at the top and bottom of the uppermost and lowermost envelope, respectively, and between each adjacent envelope.

4. The envelope of claim 1 wherein said supporting means includes a plurality of upright members arranged in a ring, and including a rod connected between said membrane and each said upright member for decreasing the buckling length of said upright member.

5. The envelope of claims 1, 2, 3 or 4 wherein each said membrane is formed of a boarding having high tensile strength within its plane in all directions.

* * * * *